United States Patent [19]

Hepp

[11] Patent Number: 4,579,233

[45] Date of Patent: Apr. 1, 1986

[54] ADJUSTABLE KNOCKDOWN TRAY ASSEMBLY

[76] Inventor: James Hepp, 40 Railroad Ave., Glen Head, N.Y. 11545

[21] Appl. No.: 639,045

[22] Filed: Aug. 9, 1984

[51] Int. Cl.[4] ..... A47F 3/14

[52] U.S. Cl. ..... 211/126; 211/133; 211/194

[58] Field of Search ..... 211/126, 133, 188, 194; 52/630, 291, 664; 206/509, 511, 512; 108/91, 111

[56] References Cited

U.S. PATENT DOCUMENTS

| | | | |
|---|---|---|---|
| 982,538 | 1/1911 | Bliss . | |
| 1,572,340 | 2/1926 | Warren . | |
| 2,469,232 | 5/1949 | Kennedy | 108/111 |
| 2,591,049 | 4/1952 | Butsch . | |
| 3,053,397 | 9/1962 | Bliss . | |
| 3,095,093 | 6/1963 | Pelak | 211/126 |
| 3,141,554 | 7/1964 | Sussman et al. | 211/126 |
| 3,172,542 | 3/1965 | Nawman et al. . | |
| 3,426,913 | 2/1969 | Abatiell . | |
| 3,480,154 | 11/1969 | Telfer . | |
| 3,490,602 | 1/1970 | Wentzel . | |
| 3,784,083 | 1/1974 | Pfaffendorf . | |
| 3,955,681 | 5/1976 | De Zinno | 211/13 |
| 4,428,487 | 1/1984 | Hepp | 211/126 |
| 4,467,927 | 8/1984 | Nathan | 108/91 X |
| 4,480,756 | 11/1984 | Belokin, Jr. | 211/133 X |

*Primary Examiner*—Ramon S. Britts
*Assistant Examiner*—Sarah A. Lechok Eley
*Attorney, Agent, or Firm*—A. A. Saffitz

[57] ABSTRACT

A knockdown tray assembly comprising a plurality of horizontal rectangular trays made of paperboard or cardboard from a one-piece blank and supporting members formed by interfitting a T-beam bracing member over a comparable T-beam by the interfitting of a pin on the top of the beam with a socket at the bottom beam at the center, these beams serving as a cross brace below the tray and each of the beams having a double socket at the end with a supporting web, these double sockets adapted to receive tubular members which are supported on the webs. The sockets each have a flange and each of the trays has a hole cut out at the corners for the insertion of the socket. Tubular posts fit in each socket above and below the trays to form the assembled rack useful for storage or display. The trays are different from the ordinary cardboard trays in that they are free from metal fasteners and have cut-outs at the corners which adapt them to serve as the shelves to bear substantial loads in a shelf system in which there are no locking parts.

10 Claims, 15 Drawing Figures

ADJUSTABLE KNOCKDOWN TRAY ASSEMBLY

BACKGROUND OF THE INVENTION

A. Field of the Invention

The field of the invention is in the field of low-cost knockdown shelf systems wherein individual shelves are in the form of trays made of a low-cost material having relatively high strength such as fiberboard or paperboard and wherein the vertical spacing between the shelves or trays is provided by tubular posts at the four corners of the rectangular shelves or trays.

B. Description of the Prior Art

Senge, U.S. Pat. No. 925,538, granted Jan. 24, 1923, discloses the basic construction of three wooden or metal desk trays separated by posts which are accommodated in sockets at the outside of the trays near the four corners. The posts may be rods or tubes.

An improvement of this desk tray assembly which is found in most United States government offices uses metal die cast tubes to separate the metal trays and a flange is provided on the outside of the tubes to assure alignment of the trays. In short, the flanges serve to assure the vertical distance between the trays is the same at all four corners and that each of the trays is level and parallel to the base tray.

My prior U.S. Pat. No. 4,428,487, to Hepp, shows a sectional display in which angular corner posts engage grooved portions on the underside of plastic trays. In order to achieve alignment at the four corners in a vertical assembly of three to five shelves of the rack, a plurality of rib portions are provided to assure engagement and locking of the corners. The construction is very sturdy but does not meet the need of a low-cost rack which is used mainly for storing rather than for display but which still is capable of supporting heavy loads and does not require the use of relatively expensive molded plastic, wood, or metal for the construction of the trays or shelves.

An all plastic knockdown shelf assembly is on the market commercially which consists essentially of molded plastic trays having corner apertures, and tubular plastic posts fitting in these apertures resting on flanges which provide the desired vertical spacing of the rack used in display.

Paper trays are known for use in shelf storage and handling systems, for example, a paperboard tray constructed of a single blank used in handling and sorting mail, is shown in Pfaffendorf, et al, U.S. Pat. No. 3,784,083. However, such paperboard trays have not been heretofore used in an assembly in the type in my prior U.S. Pat. No. 4,428,487.

Constructions using sockets and tubes comparable to the commercially available desk trays have also been used for example in the U.S. Pat. No. 3,480,154, to Telfer, and the U.S. Pat. No. 3,053,397, to Bliss. Telfer supports only one side of the trays and uses half tubes. Bliss stacks his trays for relatively heavy loads such as vegetables.

Abatiell, Jr., U.S. Pat. No. 3,426,913 in FIGS. 3 and 5 shows a combination all divider shelf assembly having double sockets but these structures require locking devices to make them stable.

Butsch, U.S. Pat. No. 2,591,049 discloses a sectional rack for storing heavy stock which use I beams to support the load. However there is no concept of cross-bracing the beams.

Warren, U.S. Pat. No. 1,572,342 shows a special rack for spools of friction tape material used for brake linings in which a series of parallel X members pivot about a common vertical rod and the spools are placed in the spaces between the X members.

Nawman, et al, U.S. Pat. No. 3,172,542 shows a tray having a paper bottom which is reinforced by a cross brace.

Wentzel, U.S. Pat. No. 3,490,702, describes a disposable paper tray in which the bottom panel is made of paperboard and is reinforced by cross braces.

DISTINCTIONS OF THE INVENTION OVER THE PRIOR ART

None of the prior patents show the support posts protruding in an adjustable post and double socket arrangement through the floor of the tray itself which permits different displays to be set up by using different trays. None of the prior art shows beams in the adjustable position where the beams combine with the end sockets and serve as the supports below the tray and cooperate with the posts to permit the shelf to be long and narrow or square as in the present invention and at the same time support heavy loads.

Although there is a teaching of a pivoted rack in which a plurality of X frame members pivot about a vertical rod which extends through the entire assembly as in Warren, U.S. Pat. No. 1,572,340, this X frame system is not capable of accommodating different size trays for display.

OBJECTS OF THE INVENTION

It is an object of the invention to provide a low-cost knockdown tray assembly adapted for relatively heavy articles and comprising a plurality of spaced apart trays which consist of low-cost paper, fiberboard, or cardboard material and which can be used for storage or for display.

A further object of the invention is to provide a novel interfitting T-beam reinforcing assembly which pivots at the center of each beam to accommodate different size trays, e.g. different widths in a set of rectangular trays, the corners of each of the rectangular trays being cut out to accommodate post receiving sockets and posts in these sockets which space the trays in the shelf assembly at the desired distances and in which the sockets are provided with flanges adapted to support the cut-out portions of the tray within the corner areas.

SUMMARY OF THE INVENTION

The invention is in the field of knockdown tray assemblies comprising as a critical reinforcement member an adjustable T-beam pivoting assembly which can be adjusted to support trays which are rectangular in shape but which can vary from broad to narrow which are supported by cross-brace members, each in a T-beam construction and pivoting to provide an adjustment of different rectangular sizes, the ends of the T-beams being fitted sockets to accommodate tubular posts which provide the vertical spacing and the trays being cut out to receive the sockets, each of the sockets having a flange portion supporting the tray at the cut-out portion in the corner.

The invention comprises a knockdown tray assembly having as its critical reinforcement member a novel interfitting T-beam pivoting assembly which consists of two similar T-beams each formed at its end with a double socket and a center web which adapts the upper flange of the T-beam in the pivoted assembly to serve as supporting diagonals for a tray or shelf of the rack and in which the corners of each tray are cut out with circular apertures to accommodate posts which fit into the sockets at the ends of the beams, the sockets protruding through the apertures in the trays thereby aligning the trays of the arrangement at the desired vertical space between the shelves. In the novel interfitting T-beam pivoting assembly, one of the beams is a pin beam since it is provided at its center with a pin element which fits into a socket or sleeve element at the center of the other T-beam. The supporting surfaces are the top beam of the T-beam flange, e.g. the top flange and the pivoting area at the center in the assembly is characterized by a cut-out portion for each top flange of the pin beam and the sleeve beam, this cutout portion permitting a free pivotal swinging of the top beam over the bottom beam so that the end sockets can be swung into various configurations to adapt to the cut-out apertures in the trays of the different sizes of a series of trays for storage or display purposes. To illustrate the demonstration model of the invention which the inventor has used, the same interfitting T-beam pivoting assembly can be used to support a tray having square dimensions of about 19"×19" or long and narrow dimensions of about 10"×25". In a display the addition of 50% more of display frontage with the same display assembly represents a very important commercial benefit to the user of this equipment.

The trays of the knockdown tray assembly are different from those in the prior art in that they are free from any plastic or metal fasteners and are adapted to be used to support electronic equipment, particularly magnetic tapes, floppy discs and equipment which may include much information which will be affected in storage by having nearby metals to distort the magnetic memory parts of the contents.

In one embodiment the invention may include only trays and posts made of paper fibers and corrugated paper to permit a lowcost display or storage system while in another embodiment the posts may include plastic posts which are waterproof and can serve as legs for the assembled rack in areas where the floor may be wet.

DESCRIPTION OF THE PREFERRED EMBODIMENTS

Figure 14:
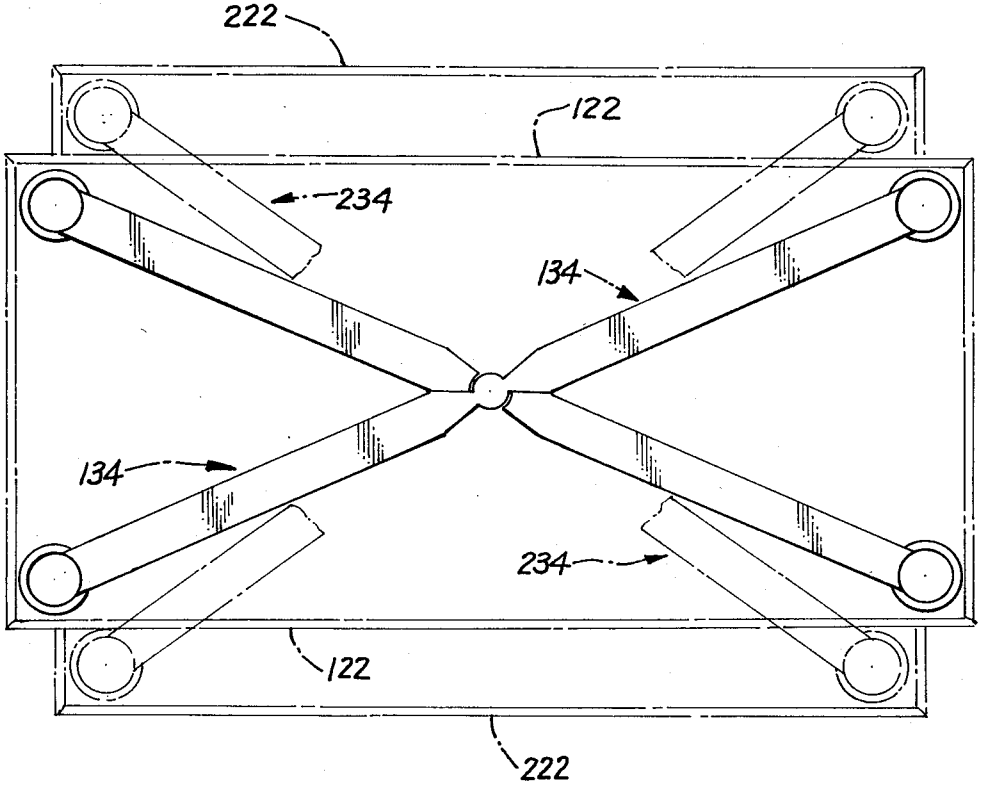
FIG. 14 is a diagrammatic plan view, showing the adjustment of the support arms for various tray sizes.

In FIGS. 1–4 there is shown a preferred storage tray assembly 20 of the present invention comprising a plurality of horizontal rectangular trays 22 each fitted with support tubular posts 31 within the tray so that each post engages a corner socket 42 supporting the tray which is located within a cut-out circular opening 25 in the bottom 24 of the tray at each corner thereof. The bottom 24 is planar. The tray 22 is preferably formed of a single blank of paperboard or cardboard material as is shown in the pattern blank of FIG. 15. The tray is preferably formed without the use of any metal or plastic fasteners to adapt the storage assembly 20 for storing electronic components, magnetic tapes and the like which are affected by metal.

The tubular posts 31 are similar in material to the material of the tray 22, e.g. they are formed of paperboard fibers, are very strong, are light in weight, these posts being used in the textile industry as bobbins for heavy wound yarns weighing from 300 to 600 pounds. The posts of the invention are obviously of smaller diameter than the posts used in bobbins but are nevertheless of comparable strength, can be cut very accurately with standard cutting machinery and are adapted to support very heavy loads in the finished tray assembly, particularly when the trays are stacked to form three shelves as shown in FIG. 1.

The combination of the novel metal-free storage cardboard tray having the cut-out openings or aperture 25 in the bottom 24 of the tray at each corner thereof cooperates with the special sockets 42. The corner sockets 42 are special double socket constructions formed by a detachable X-brace 34 which is a brace forming the supporting members for the bottom of each tray which can be detached by simply removing the post above the tray and thereafter removing the socket below the tray, the aperture 25 serving for the purpose of receiving the socket which is integrally attached to the supporting beam with which it is associated.

Figure 4:
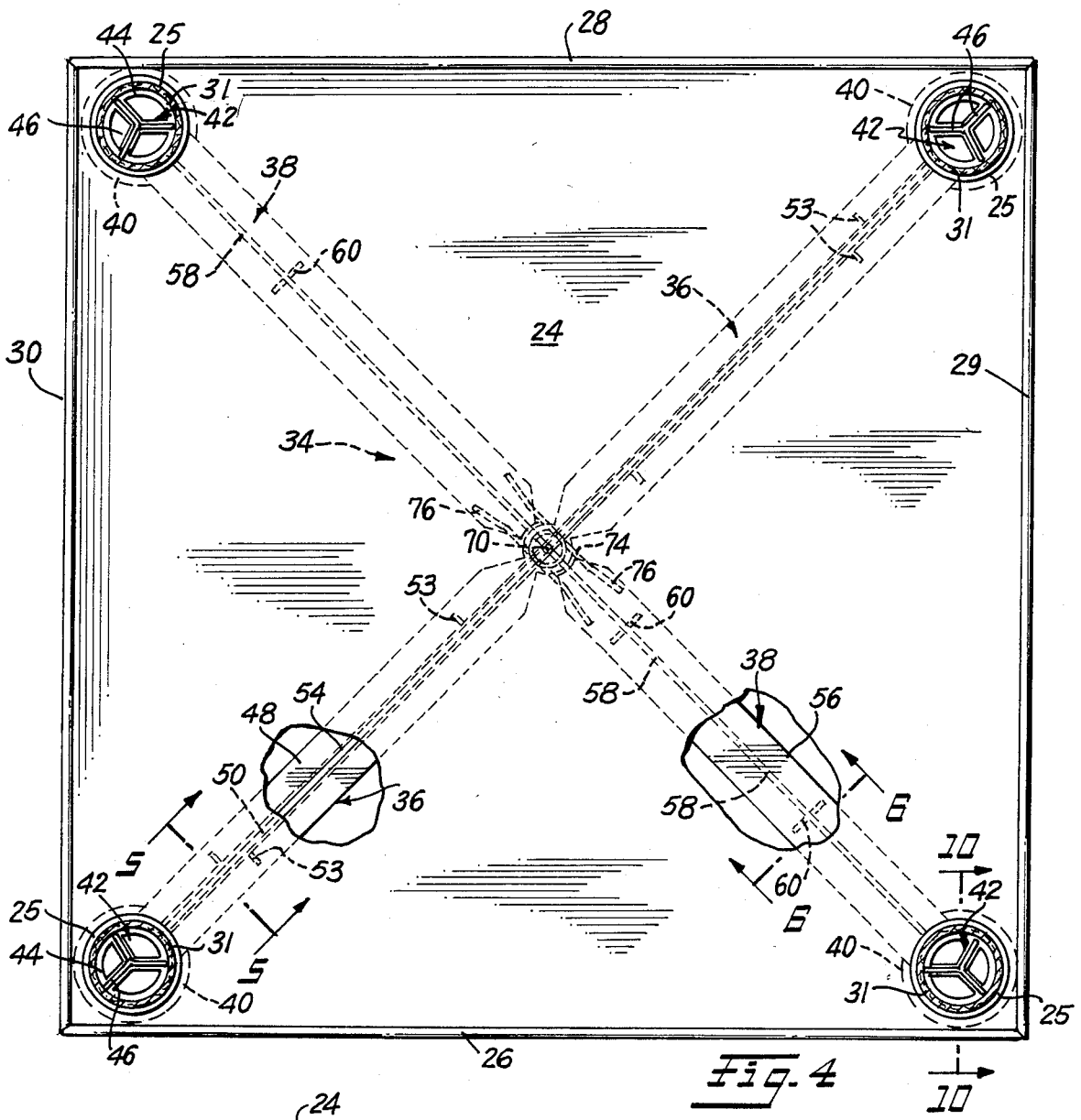
FIG. 4 is a horizontal sectional view, taken on the line 4—4 of FIG. 2.
Figure 5:
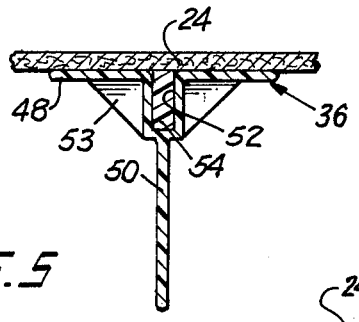
FIG. 5 is an enlarged fragmentary horizontal sectional view, through one of the T-shaped adjustable supports taken on the line 5—5 of FIG. 4 showing a non-metallic reinforcing bar in place.
Figure 6:
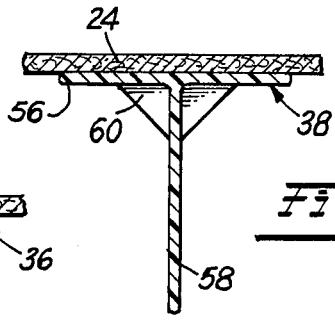
FIG. 6 is an enlarged fragmentary horizontal sectional view, through the other T-shaped adjustable support, taken on the line 6—6 of FIG. 4.
Figure 7:
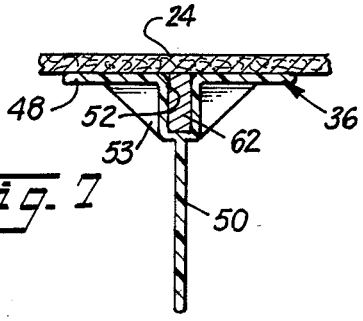
FIG. 7 is a view, similar to FIG. 5, showing a modification wherein a metallic reinforcing is used.
Figure 8:
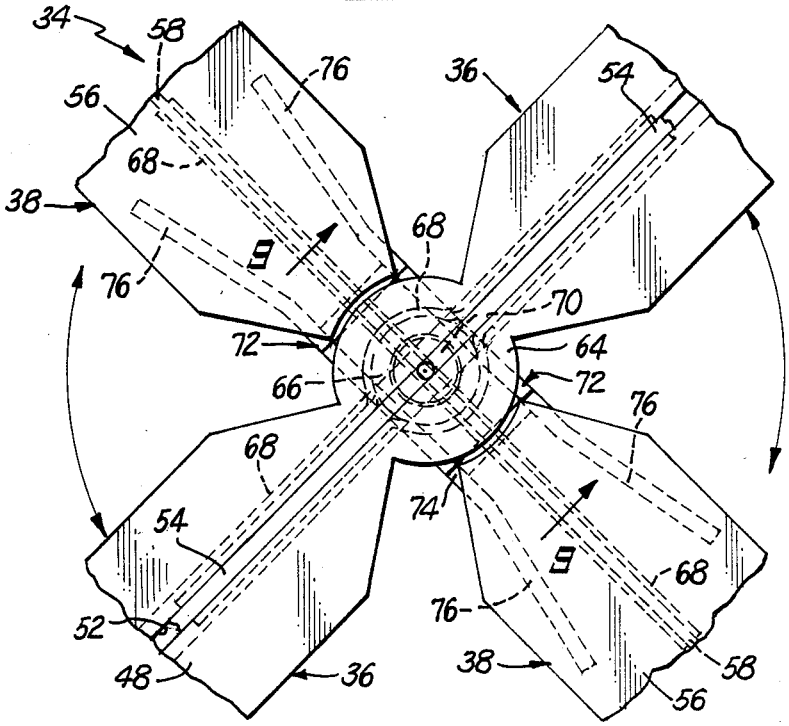
FIG. 8 is an enlarged fragmentary top view of the pivotal connection of the storage tray supporting arms.
Figure 10:
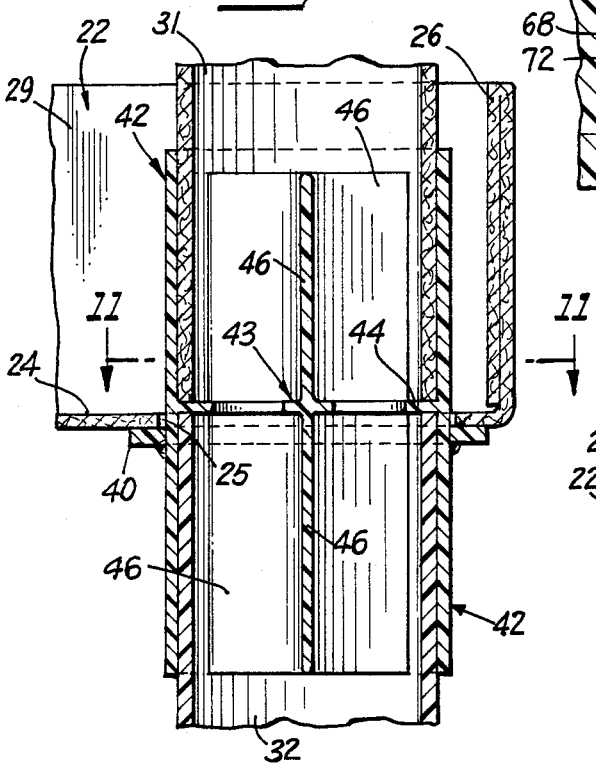
FIG. 10 is an enlarged fragmentary vertical sectional view through one of the tray supporting posts, taken on the line 10—10 of FIG. 4.
Figure 9:
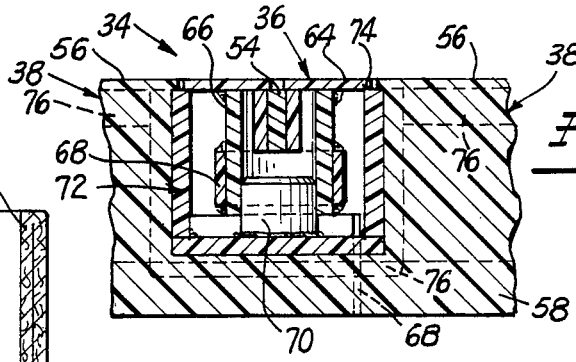
FIG. 9 is a fragmentary vertical sectional view, taken on the line 9—9 of FIG. 8.
Figure 11:
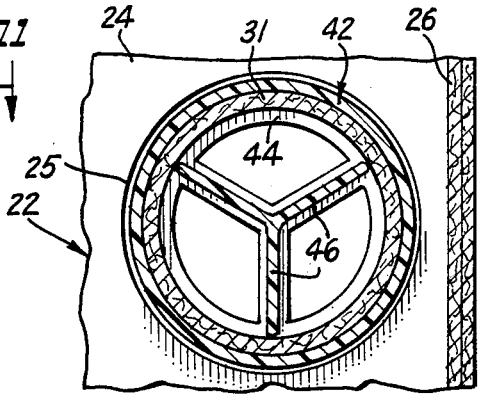
FIG. 11 is a horizontal sectional view, taken on the line 11—11 of FIG. 10.

The tray-cross-arm support structures 34, 134 and 234 illustrated in FIGS. 4 and 14 respectively, comprises a T-shaped arm. As seen in FIG. 4 the arms 36 and 38 have end sockets 42 secured at the ends of the top flange. The cross-arm assembly is formed from an F-shaped arm 36 and a T-shaped arm 38 which differ in construction each from the other because of the specific center construction in the T-shaped pivoting arms, as shown in FIGS. 8 and 9. The general arrangement of the T-shaped pivoting arms in the pivoted interlocking engagement is illustrated in FIG. 9 and is adapted for the supporting function of the tray assembly of FIG. 1 wherein the tray is a square tray but the tray assembly may be a rectangular tray which is narrower than the square tray in one dimension and longer in another dimension. This adjustable feature is to accommodate various tray sizes and is shown in FIG. 14. Smaller diameter posts used in bobbins are nevertheless of comparable strength, can be cut very accurately with standard cutting machinery and are adapted to support very heavy loads in the finished tray assembly, particularly when the trays are stacked to form three shelves as shown in FIG. 1.

Figure 1:
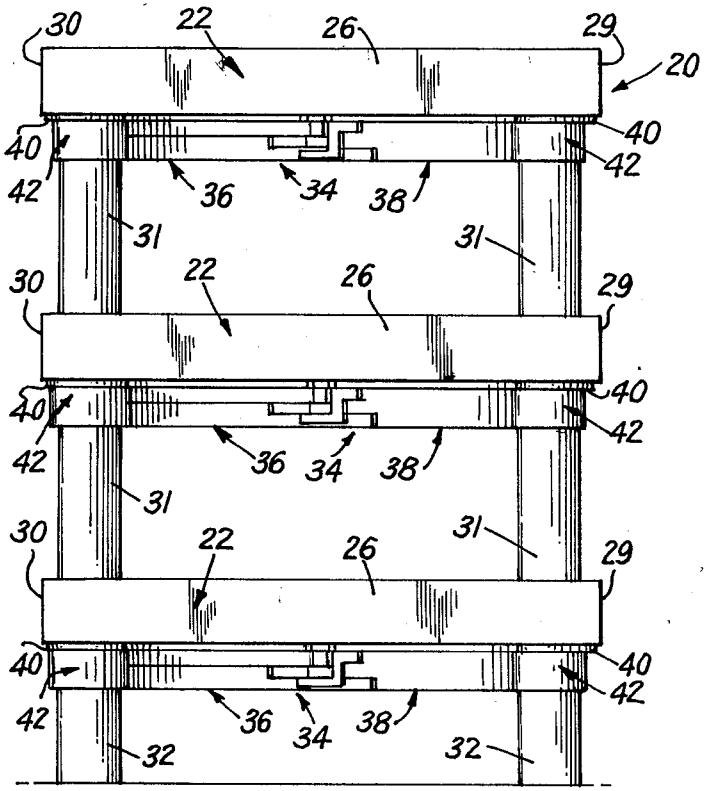
FIG. 1 is a front elevational view of the storage tray assembly of the present invention.

The legs 32 in the embodiment shown in FIG. 1 are formed of plastic material which is of a sufficient thickness in the tubular construction so that the entire load will be supported.

Figure 15:
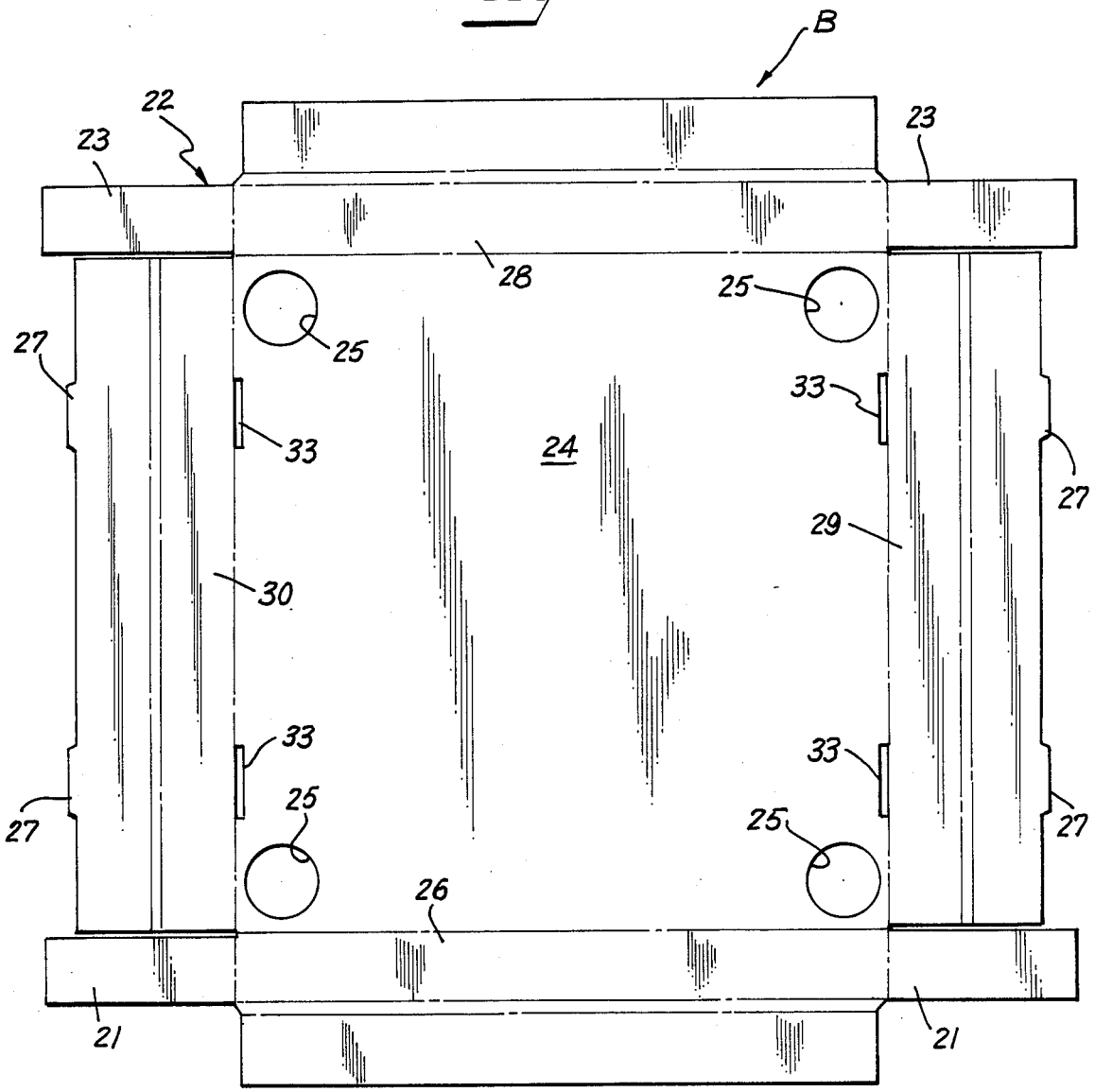
FIG. 15 is a pattern blank for the trays shown in FIG. 4.

In a tray which has an interior dimension of 19"×19", the tray being formed of a single blank of cardboard as shown in FIG. 15, the cardboard being B-flute and having a test strength of 175 pounds, the rack can support 12 bottles of soft drinks or 12 bottles of wine on the bottom and middle shelves and 12 gallon bottles of wine on the top shelf. In this prototype model the tubular posts 31 are each 2 inches in diameter, each has a thickness of ¼ inch and is made of wound paper. The legs 32 are formed of high impact plastic, have the same dimensions and are 4 inches high while the posts are 14 inches high.

The combination of the novel metal-free storage cardboard tray having the cut-out openings or aperture 25 in the bottom 24 of the tray at each corner thereof cooperates with the special sockets 42. The corner sockets 42 are special double socket constructions formed by a detachable X-brace 34 which is a brace forming the supporting members for the bottom of each tray which can be detached by simply removing the post above the tray and thereafter removing the socket below the tray, the aperture 25 serving for the purpose of receiving the socket which is integrally attached to the supporting beam with which it is associated.

Reference is now made to FIGS. 14 and 15 to show the matching of a one piece cardboard blank to a 10"×25" display shelf, e.g. 10" deep and 25" long and also to a 19"×19" storage shelf using the same detachable tray-supporting X brace 34 for displaying wine bottles which are 11 inches tall and in which the posts 31 are formed of pressed paper material which is in the form of a tube having a thickness of ¼" and a height of 14" to provide an inner shelf space of 14" and wherein the legs 32 are formed of plastic consisting of tubes 4" high and ¼" thick. The 19"×19" square tray formed of the blank of cardboard B which has a square configuration to provide the bottom 24 having the 19"×19" inside dimension, sides 29–30 and ends 26–28 can easily accommodate 12 wine bottles. The 10"×25" tray, these dimensions being the inside dimensions, is formed of the same structural configuration of the blank B consisting of cardboard but the dimensions are obviously different and the display embodiment utilizes the identical detachable X-brace assembly which is manipulated in the manner illustrated in FIG. 14 to insert the sockets 42 into the cut out openings 25 of the longer tray for display purposes rather than in the square tray for storage purposes. Since the available surface areas in the square tray is substantially higher than in the long and narrow display tray it is obvious that the user of the tray assembly system may interchange assemblies for display and for storage and change the bottles which are on display. The fact that the legs are formed of plastic which is strong and waterproof makes the assembly in the rack of FIG. 1 particularly useful for long term display in the retail store window in which it is desirable to frequently wash and clean the floor without having to remove the rack and bottles which are displayed thereon.

In FIG. 15, the one-piece pattern blank B for the preferred metal-fastener-free cardboard tray having square dimensions is shown, the left side wall 30 and the right side wall 29 having the same dimensions and the front wall 26 and the rear wall 28 of the tray 22 when set up. The blank B is formed at its side edges with locking tabs 27, a spaced pair for the left side wall 30 and a spaced pair for the right side wall 29, each of these tabs 27 when the side walls are folded inwardly along the medial fold line engaging corresponding slits 33 in the blank body to lock these sides in metal-fastener-free engagement to the bottom 29. Before the tabs 27 are locked, the front and rear walls 26 and 28 are similarly folded inwardly with the front tabs 21 pivoted to underly the outer fold of right side wall 29 and the rear tabs 23 pivoted to underly the outer fold of left side wall 30.

In the preferred form of one-piece cardboard or paperboard blank the planar bottom 24 is present at the corners to provide circular apertures or openings 25 whose diameter is sufficient to accommodate the circular shape of the sockets 42 which terminate each of the T-shaped arms 36 and 38 of the tray cross-arm support structure.

Figure 12:
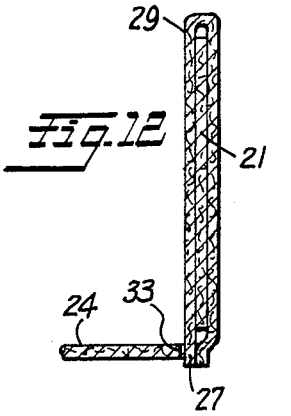
FIG. 12 is an enlarged fragmentary vertical sectional view, through one side of a tray, taken on the line 12—12 of FIG. 3, showing a manner of locking a side of the tray assembly.
Figure 13:
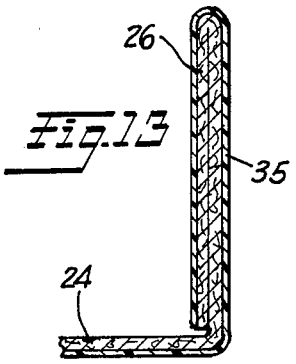
FIG. 13 is a vertical sectional view, through the side of a tray showing a modification wherein the outside surfaces of the tray have a protective coating.

As shown in FIG. 13 a protective coating 35 is a desirable structural feature to improve the resistance of the tray 22 against accidental attack by liquids, either soft drinks or alcoholic beverages. Synthetic resin coatings based upon commercial vinyl resin liquid formulations such as vinyl chloride-vinyl acetate copolymer lacquers or aqueous dispersions of such copolymer resins are available in any desired color and shade and can be applied to achieve the desired thickness of 0.001–0.010 mils by spraying, immersion, or brushing to provide any desired hue or shade of waterproofed tray. The Blank B may be coated before folding and this is the preferred construction of the embodiment of FIGS. 12 and 13 where the waterproof tray is desired.

Other coatings based upon acrylic resins may be used, such as those based on alkyl acrylate, alkyl methacrylate and acrylic acid, these being commercially available in the form of clear or pigmented aqueous dispersions and organic solvent dispersions and having the advantage of being light resistant and age resistant.

Also commercial polyurethane coatings may be used. All of these coatings, vinyl, acrylic, or polyrethane are preferably used over a primer coating such as water glass-casein sealer or a vinyl carboxylic copolymer sealer or an acrylic acid acrylic ester copolymer sealer.

The sides of the rectangular tray 22 may have different dimensions and to illustrate these different dimensions attention is invited to FIG. 14 which illustrates the horizontal trays in different sizes, e.g. horizontal tray 122 in which the width dimensions of the rectangular tray are far less than the width dimensions in horizontal tray 222 which is shown in phantom lines immediately below tray 122 and in which the support structure 134 has an open configuration for the cross arm support elements which is totally different from the configuration shown in the more divergent open form of the support structure 234. FIG. 14 illustrates two other tray sizes which are species of rectangular trays 22 different from the tray size in FIGS. 1–4, e.g. oblong with a narrow side and a long side rather than square as shown in FIGS. 1–4. This feature of different horizontal tray sizes 22, 122 and 222, usable with the identical cross arm structure represented by 34, 134 and 234, respectively, demonstrates an adjustability of support area which is unique in the storage tray assembly 20 of the present invention.

As pointed out above, the paper construction of the tray 22, 122, or 222 in no manner militates against the use of the tray in display or in the handling of liquid filled or partly filled containers which may spill their contents during movement. In case of spill, the tray material survives because of its water impermeable structure; in this connection although synthetic resins have been exemplified as preferred coatings in FIG. 12, the coatings may also be microcrystalline wax alone or modified with polyethylene. Wax is a natural product recovered by refining heavy petroleum crude. Other waxes may be used, e.g. natural or synthetic waxes and these are well known.

The accommodation of the sockets 42 in each of the openings 25 of the horizontal trays 22 is an essential requirement in the embodiments of all of the tray sizes illustrated in FIG. 14. In this connection, the details of the support structures represented by cross arm supports 34, 134, and 234 respectively, is best understood by the illustration in FIGS. 2, 3 and 4. The cross arm support 34 comprises a T-shaped arm 36 and a cooperating T-shaped arm 38 which terminate in the double sockets 42, these sockets 42 each comprising an upper half and a lower half which is defined by means of a shelf 44. To guide the tubular posts 31 within the sockets 42, each socket is formed with spider-like parts for creating a guide to fit the thickness of the tube within the space from the edge of the spider to the internal surface of the socket. These partitions 43 in socket 42 occur above the shelf 42 and below the shelf 42 creating a true double socket having a single shelf and double spider partition.

The T-shaped arms 36 and 38 are strengthened on the vertical flange 50 by reinforcing ribs 53. The horizontal flange 48 of the T-shaped arm 36 is a load bearing flange which supports the underside of the tray 22.

Figure 2:
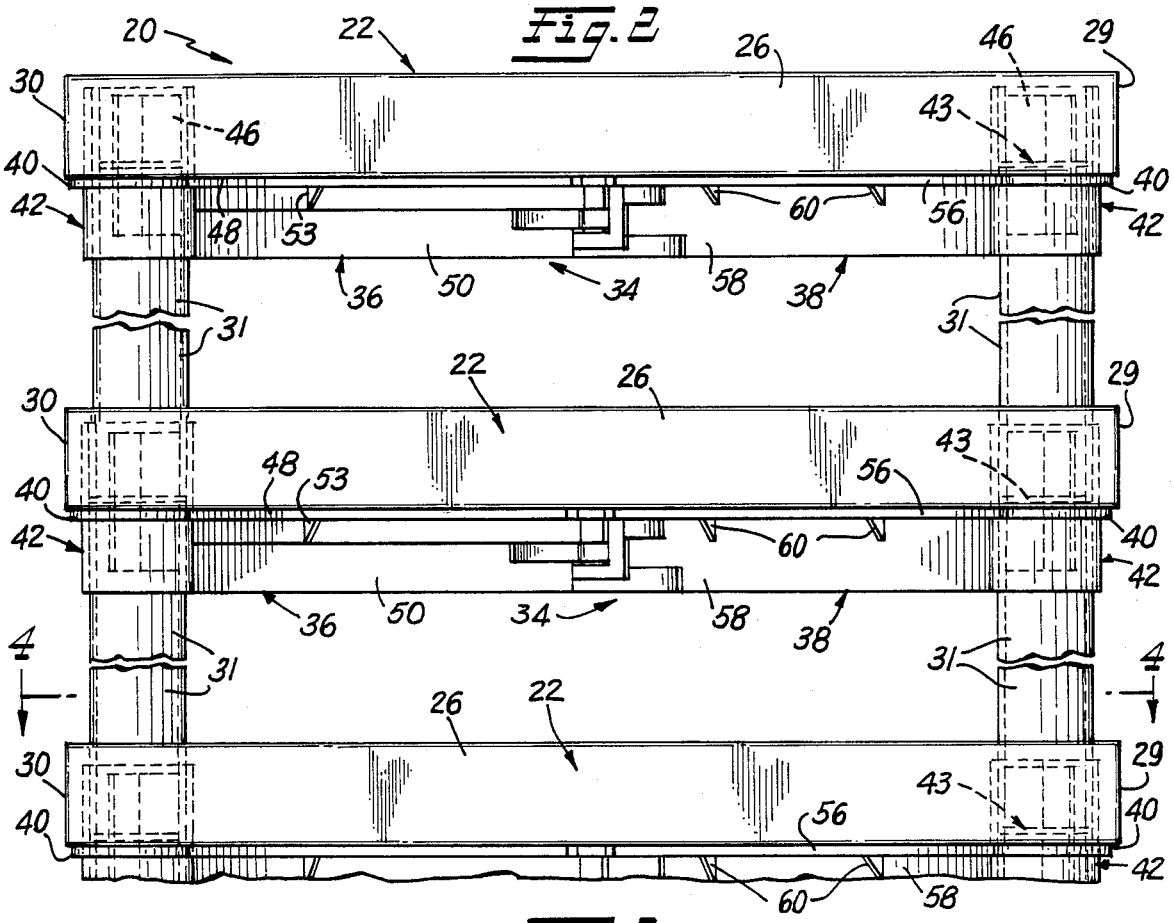
FIG. 2 is a fragmentary front elevational view, on a larger scale, illustrating the storage tray assembly in greater detail.
Figure 3:
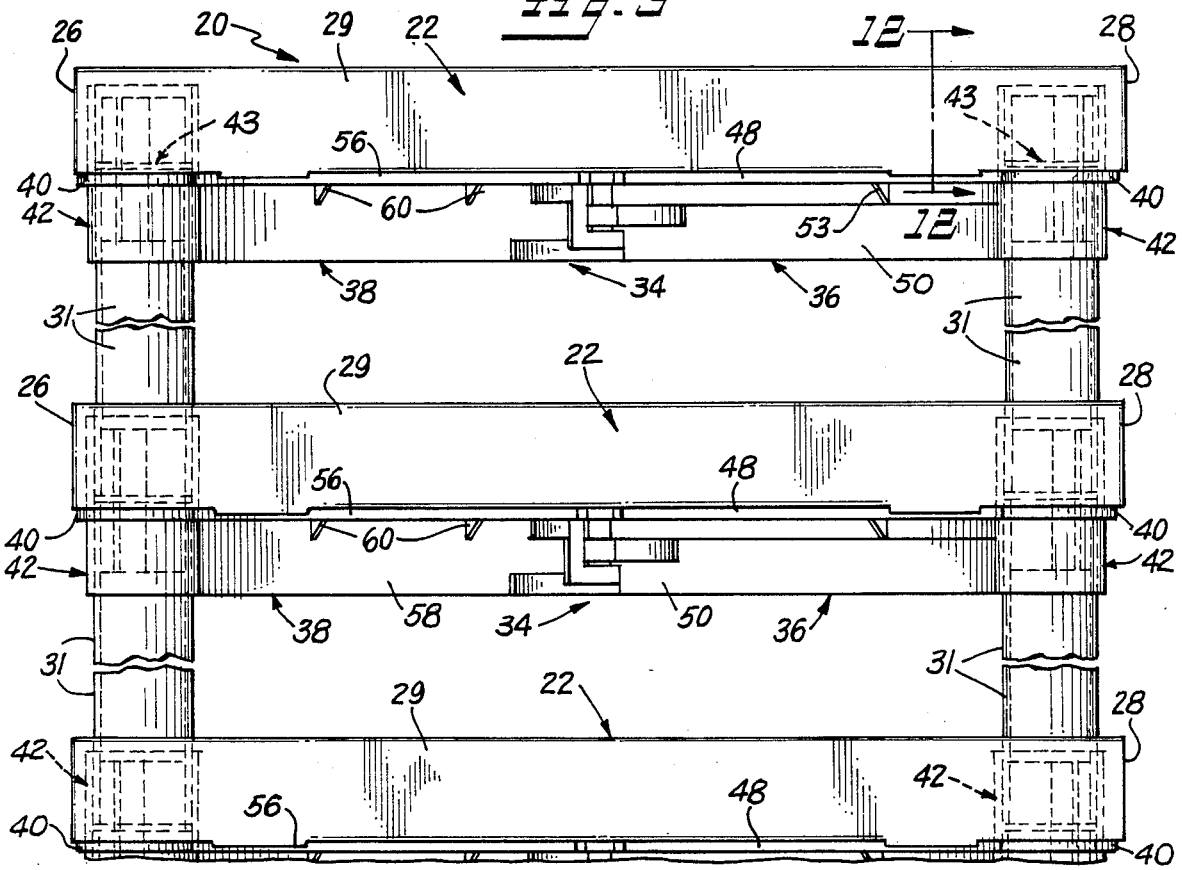
FIG. 3 is a fragmentary side elevational view as viewed from the right of FIG. 1.

As shown in FIGS. 2 and 3, a center groove is formed in the upper surface of the horizontal flange 48 in the T-shaped arm and this groove is sufficiently wide to accommodate a rod or wire of strong steel along the entire length of the horizontal flange 48 on both sides of the pivoting center. The strengthened bar formed of metal is identified by reference numeral 62.

In those instances where storage or display of articles is to be accomplished in the storage tray assembly 20 without any presence of metal of any kind, the strengthening bar or wire which is inserted in the groove of the upper T-shaped arm 36 may be of high strength plastic. Obviously, if the articles are to be protected only from ferro-magnetic disturbances then any strong material may be used which is not magnetic, or a ceramic rod can be used.

Tray cross-arm support 34 which comprises the articulating bar of T-shaped arms 36 and 38 is fitted with a pivoted connection 70 allowing the arms 36 and 38 to be adjusted to various size trays. A hollow boss 66 is fastened to the arm 36. The T-shaped arm 38 is formed with a horizontal flange 56 which is the load bearing flange under the tray 22 and a vertical flange 58. In a manner similar to the reinforcement of the vertical flange of the T-shaped arm 36, reinforcing ribs 60 are provided on the vertical flange 58 of the T-shaped arm 38 which pivots with T-shaped arm 36. The articulation of the T-shaped arms 36 about the pivot pin 70 is similar to that of a scissors but based upon the load bearing requirement of the T-shaped arm 36 in the diagonal direction and a similar load bearing requirement exists for the crossarm support represented by T-shaped arm 36 which provides the boss 66 at its center pivot.

The interchange of the pivot to the lower arm and the boss to the upper arm is less preferred because it interferes with taking the tray assembly apart, namely, the lower pin will fall out and it will be necessary to lift the cross arms at the pivot to hold the cross arm assembly together and to prevent the arm from falling away by gravity.

The horizontal flanges of the respective T-shaped arms 36 and 38 are formed with a narrowed portion immediately adjacent the pivot structure at the center, each arm 36 and 38, respectively, having a circular form at the center top portion where the pivot is located and each being provided at the vertical flange with strengthening ribs 76 to compensate for the loss in load carrying ability which is due to the shortening or lessening of the horizontal surface immediately next to the pivot. The balancing surface for the center flange 64 is identified by reference numeral 74, as seen in top view in FIG. 4 and in sectional view in FIG. 9. The T-shaped arm 38 which is the top tray cross-arm support of the cross-arm structure 34 is shown in FIG. 8 and it is seen that a U-shaped bridge element is formed by T-shaped arm 38 which is identified by the reference numeral 72, this U-shaped bridge element serving as a bumper and a brace in the scissorslike articulation of the cross arms about the pivot pin 70 in the boss 66 which is shown in dotted section at the center portion of FIG. 8. Similar strengthening ribs 76 as in the T-shaped arm 38 are provided with the T-shaped arm 36.

FIG. 8 also shows the strengthening bar 54 which is placed in the groove 52 in the top horizontal flange 38 of the T-shaped arm 36 which constitutes the pivot bearing arm of the tray crossarm support structure 34. The movement of the upper cross arm 36 and the lower cross arm 38 to the articulation having narrower sides and a longer front as in the view in FIG. 14 moves the strengthening ribs 76 and the U-shaped bridge elements 72 closer to the vertical flanges on either side of the center boss and pin so that the U-shaped bridge element serves with the ribs 72 to maintain the pin and boss in proper alignment and thereby keeps the level at the center of the cross-arm supports in the same plane as the level at each of the corner sockets and at each of the corner openings in the tray.

The sockets 42 at each of the four corners of the tray in FIG. 4 are formed integrally with T-shaped arms 36 and 38 of the cross-arm support structure 34 and each socket 42 comprises an inner shelf 44, an outer tray support flange which constitutes the flange support below the cut-out portion of the tray, cut-out 25, and includes guiding means for the vertical posts 31. The guiding means comprise the spider partition 43 upon which the post rests which post constitutes the post between the tray supported by the flange 40 and the tray above that tray, the tray cross-arm support structure 34 underlying the tray with the socket 42 protruding through the opening 25 and the immediate area adjacent to the opening 25 resting on the flange 40. In short, the corner rod on the flange is borne by the arms 36 and 38 and each arm along its length provides three areas of support, the first about the cut-out opening 25 under the tray, the second below the planar floor of the tray 24 at the center of the crossarm support where it pivots and the third at the opposite corner, again at the cut-out portion 25. The guidance provided by the spider partition 43 is a stop guidance which requires the bottom of the post to rest against this partition, the guidance by the reinforcing ribs 46 is that of providing a spacing in which the tube fits, the structure of the reinforcing ribs fitting within the tube itself and the alignment thereby being secured. The repetition of the identical structure of reinforcing ribs below the partition permits the corresponding tube to be pressed upwardly in the socket, guided by the reinforcing ribs 46 which fit into the tube in the same manner and thereby bringing the tube above the socket and the tube below the socket into the desired alignment and thereby preventing tipping of the entire assembly when loaded with a variety of contents.

The following adjustable sizes of trays have been successfully set up to form racks:

Square: 19″×19″
Rectangular: 20″×16″
Rectangular: 23″×15″
Rectangular: 23.5″×13″
Rectangular: 23.5″×12″

The 16″×20″ tray holds 26 bottles of $3\frac{1}{2}$ inch diameter and a total weight of approximately 30 pounds.

I claim:

1. A knockdown assembly comprising:

a generally rectangular paperboard or cardboard tray made from a one-piece blank which is free from fastening elements and having cut-out circular corner portions to receive a tubular post;

a tubular post at each cut-out circular portion;

a tray cross-arm support structure consisting of two T-shaped arms pivoted at their center having a pin and boss pivot and provided with double sockets at the corners;

each socket adapted to receive at the upper and lower ends thereof a tubular post at each corner of the tray which supports the tray of the assembly;

each socket being provided with a flange extending beyond the cut-out portion of the tray and below the tray with the socket in place whereby the tray loaded with a container will be supported at the corners by the flange and at the center by the tray crossarm support structure.

2. A knockdown tray assembly as claimed in claim 1, wherein said posts are formed of high strength paper and wherein said sockets include guiding means to align the posts above and below the sockets with each other.

3. A knockdown tray assembly as in claim 2, wherein said pivot in the center of said tray cross-arm support structure comprises a pivot pin at the center of one of the T-shaped arms and a depending boss into which said pin fits which is secured to the other of the T-shaped arms.

4. A knockdown tray assembly as claimed in claim 3 wherein said T-shaped arms are provided with reinforcing ribs along the vertical flange of each of said arms in order to strengthen these arms.

5. A knockdown tray assembly as claimed in claim 3 wherein said guiding means includes a spider which guides the bottom of the post and a web at the center of the socket upon which the post is seated.

6. A knockdown tray assembly as claimed in claim 5 wherein one T-shaped arm is provided with a U-shaped bridge element to serve as a stabilizer member in the scissors manipulation of the T-shaped arms of the cross-arm support structure.

7. A knockdown tray assembly as claimed in claim 6 wherein one of said T-shaped arms is provided adjacent the pivot with strengthening ribs in order to adjust to heavy loads.

8. A knockdown tray assembly as claimed in claim 7 in which one of said T-shaped arms is provided with a groove and a strengthening bar in the horizontal flange thereof to accommodate heavier loads on said tray.

9. A knockdown tray assembly as claimed in claim 1 wherein said tray is coated with a protective waterproof coating.

10. A knockdown tray assembly as claimed in claim 1 including a plurality of trays, each with corner posts in the corresponding sockets supported by hollow tubular waterproof legs fitting in the bottom socket portions of the lowermost tray cross-arm support structure.

* * * * *